US006107755A

United States Patent [19]

Katyl et al.

[11] Patent Number: 6,107,755

[45] Date of Patent: Aug. 22, 2000

[54] MODULAR, CONFIGURABLE DIMMING BALLAST FOR A GAS-DISCHARGE LAMP

[75] Inventors: Robert H. Katyl, Vestal; Robert M. Murcko, Binghamton; David W. Dranchak, Endwell; James R. Petrozello; Scott W. Knauss, both of Endicott, all of N.Y.

[73] Assignee: JRS Technology, Inc., Endicott, N.Y.

[21] Appl. No.: 09/067,311

[22] Filed: Apr. 27, 1998

[51] Int. Cl.[7] ..... H05B 37/02

[52] U.S. Cl. ..... 315/307; 315/224; 315/56

[58] Field of Search ..... 315/56, 57, 58, 315/224, 307; 313/317, 323, 324

[56] References Cited

U.S. PATENT DOCUMENTS 2,091,953 9/1937 Becquemont .
5,315,214 5/1994 Lesea ..... 315/209 R
5,408,162 4/1995 Williams ..... 315/224
5,569,981 10/1996 Cho ..... 315/56

*Primary Examiner*—David Vu
*Attorney, Agent, or Firm*—Salzman & Levy

[57] ABSTRACT

The invention features an electronic dimming ballast for use with a gas-discharge lamp. The ballast is adapted to receive a wide variety of control signals, both from sensors near the ballast or from sensors and/or controllers located away from the ballast. The ballast is constructed on a main circuit board which contains an interface into which a wide variety of daughter circuit boards may be attached so that the ballast may be customized for a particular application or system. Typical dimming input "commands" may be from light level sensors, proximity sensors, portable, hand-held remote controllers, building energy management systems, etc. Unique interface and/or control circuitry to adapt the basic dimming ballast to these inputs is generally contained on the pluggable daughter cards.

19 Claims, 12 Drawing Sheets

MODULAR, CONFIGURABLE DIMMING BALLAST FOR A GAS-DISCHARGE LAMP

FIELD OF THE INVENTION

The present invention relates to electronic ballasts for gas-discharge lamps and, more particularly, to a configurable, dimmable electronic ballast adapted to receive a variety of auxiliary circuit cards.

BACKGROUND OF THE INVENTION

The increasing demand for energy conservation along with the growing sophistication of building-wide control/energy management systems has given rise to the need for sophisticated electronic ballast products readily adaptable for use with these systems. Because each installation has different requirements, electronic ballasts flexible enough to meet these varying requirements are urgently needed. Installation requirements may demand a wide variety of remote-control options, timers, room occupancy sensors and the like. Previous generations of ballast products could provide one, possibly two options, but were limited to performing their specific, predetermined, hardwired functions.

DISCUSSION OF THE RELATED ART

U.S. Pat. No. 5,315,214 for DIMMABLE HIGH POWER FACTOR HIGH-EFFICIENCY ELECTRONIC BALLAST CONTROLLER INTEGRATED CIRCUIT WITH AUTOMATIC AMBIENT OVER-TEMPERATURE SHUTDOWN; issued May 24, 1994 to Ronald A. Lesea teaches a dimmable electronic ballast capable of accepting an externally-generated dimming input. In contradistinction, the present invention is a complete electronic ballast packaged on a printed circuit board. The circuit board of the invention is configured to accept "daughter" boards for implementing a wide variety of dimming and other functions. The disclosed Lesea integrated circuit chip forms the basis for commercially-available control chips such as the Micro Linear ML4832 chip utilized in at least one embodiment of the present invention. Leasea neither teaches or suggests a universal ballast, particularly a universal ballast which may be configured to perform a wide variety of dimming or other control functions.

It is therefor an object of the invention to provide an electronic ballast capable of being configured to perform a variety of dimming or other control functions.

It is a further object of the invention to provide an electronic ballast wherein various dimming and control function may be implemented by plugging an ancillary printed circuit daughter board into the main circuit board of the ballast.

It is a still further object of the invention to provide a dimmable, electronic ballast capable of receiving dimming control signals which are either digital (e.g., pulse-width modulated) or analog (e.g. 0–10 volts).

It is an additional object of the invention to provide a package structure to efficiently conduct heat away from the internal ballast components thereby maintaining an internal operating temperature for the ballast which is both safe and enhances ballast reliability.

It is yet another object of the invention to provide an electronic ballast capable of monitoring both external and internal conditions.

It is a still further object of the invention to provide an electronic ballast having capability for reporting either external or internal conditions to a remote monitoring facility.

It is an additional object of the invention to provide a dimmable, electronic ballast having a smooth dimming function (i.e., flicker is minimized even for abrupt changes in dimming control input signals) in response to either an internally or externally-generated dimming signal.

It is another object of the invention to provide an electronic ballast which has a low manufacturing cost and provides for easy installation and use by consumers.

It is a final object of the invention to provide an electronic ballast having the capability for on/off control by a remote signal without using an external relay or similar device to control ballast power.

SUMMARY OF THE INVENTION

The present invention features a dimmable, controllable electronic ballast whose configuration can be easily modified to allow implementation of a variety of controlling and sensing methods. A unique packaging scheme allows for multipurpose uses of the same main ballast printed circuit card. A family of auxiliary circuit daughter cards can be plugged into the ballast to accommodate different interface requirements, such as pulse width modulated control signals from micro-controllers, analog 0–10 volt dimming signals, fiber optic or photo sensing control means, timing control functions, and sensing of ballast operating parameters such as temperature, power, lamp current and light output. Ballast parameter sensing is a feature of interest for maintenance of lighting in large buildings whose energy usage is monitored and controlled by a energy management computer network. In some larger installations the network can be extended to include an electrical utility computer so that some of the electrical load presented by the lighting system can be reduced in times of high energy usage to prevent brownouts.

BRIEF DESCRIPTION OF THE DRAWINGS

A complete understanding of the present invention may be obtained by reference to the accompanying drawings, when taken in conjunction with the detail description thereof and in which.

DESCRIPTION OF THE PREFERRED EMBODIMENT

Figure 1:
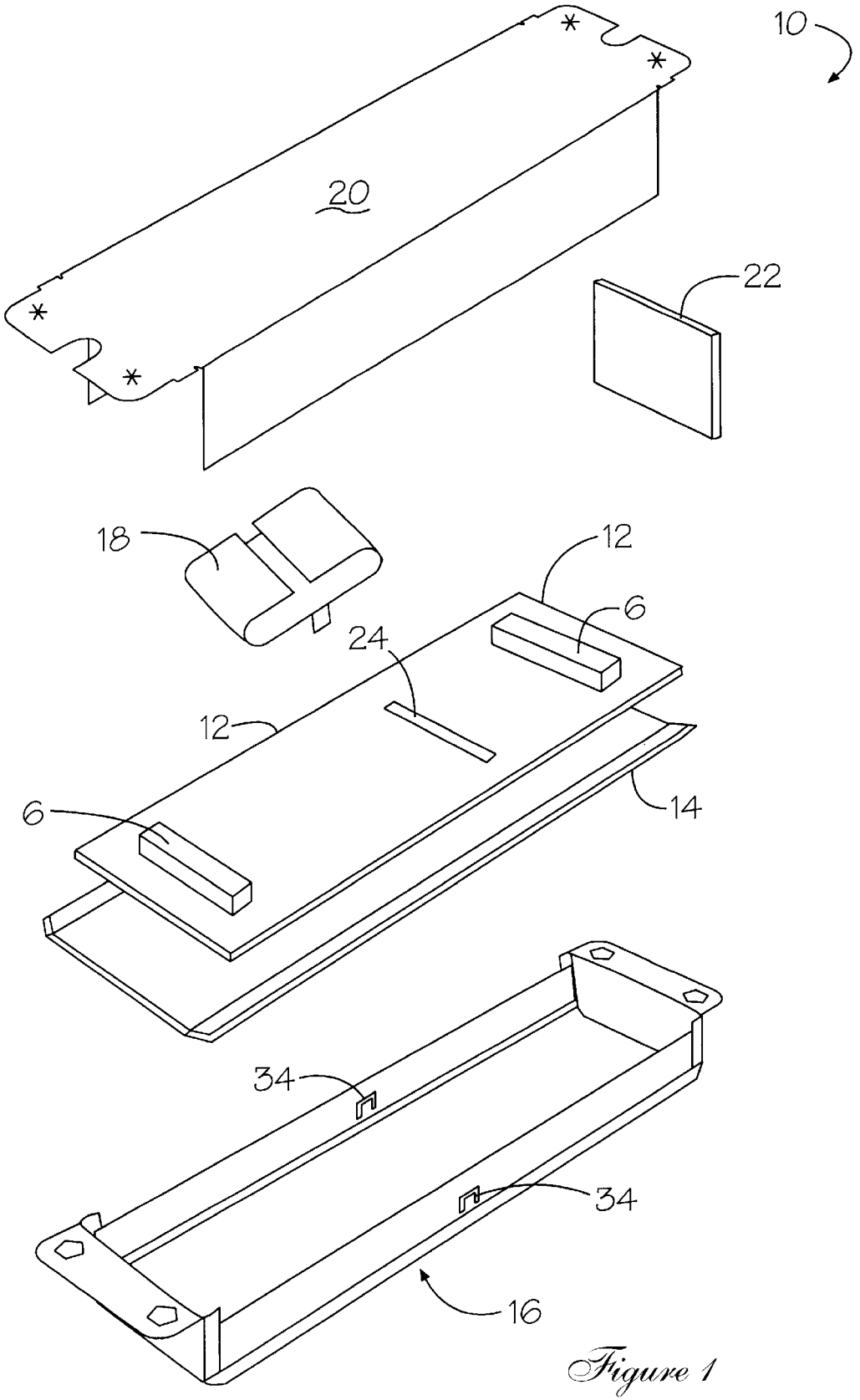
FIG. 1 is an exploded, perspective view of the package of the ballast of the present invention.

Referring first to FIG. 1, there is shown an exploded, perspective view of the ballast assembly of the present invention, generally at reference number 10. In the assembly 10, the main ballast circuit card 12 is snapped into plastic retainer 14, and held in the bottom portion of the case top 16. The circuit card 12 is held in this manner so that when it is operation in a lighting luminaire the plume of heated air from each ballast component is free to rise away from the component and reach the case bottom 20 above it which is in direct contact with the luminaire to provide the main path for heat flow from the package 10. This heat path is enhanced for the larger magnetic components by means of heat conducting structure 18, a spring like metal device that provides a thermal path from the magnetic device to the case bottom 20. Auxiliary circuit card 22 can be placed in contact with the main ballast card 12 during manufacture by use of connector 24. In this way the same main circuit card 12 can be used in different ballast applications by a simple auxiliary circuit card 22 change. Also the small card 22 lends itself to efficient manufacturing means since many cards can be produced on a large manufacturing panel, and the auxiliary card 22 can be manufactured with different assembly technology than that used in the manufacture of the main ballast card. This flexibility allows optimization of the card assembly operations, as for example, standard pin-in-hole technology might be used for the main ballast card 12, while advanced surface mount technology could be used for the small auxiliary card 22.

Figure 2A:
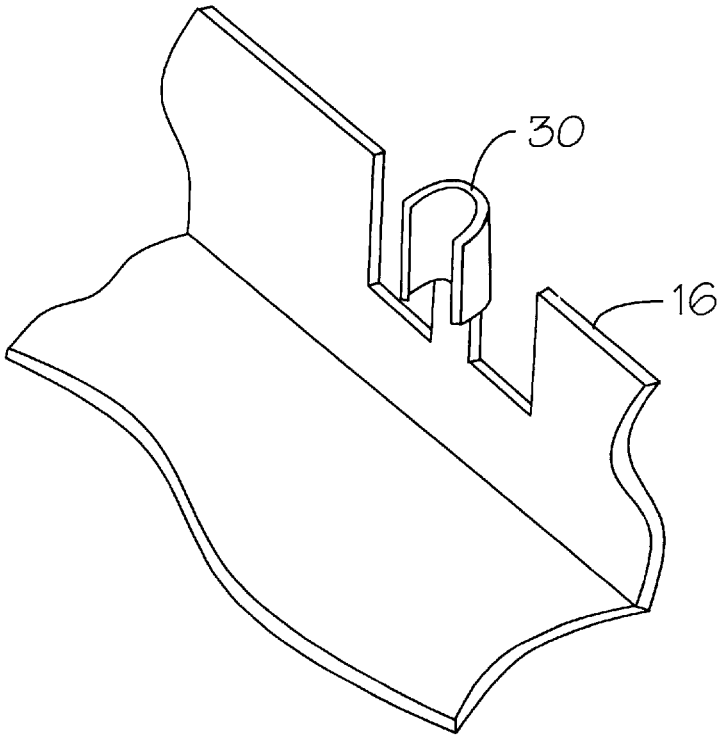
FIG. 2*a* is a detailed perspective view of the grounding crimp connection of the present invention.
Figure 2A:
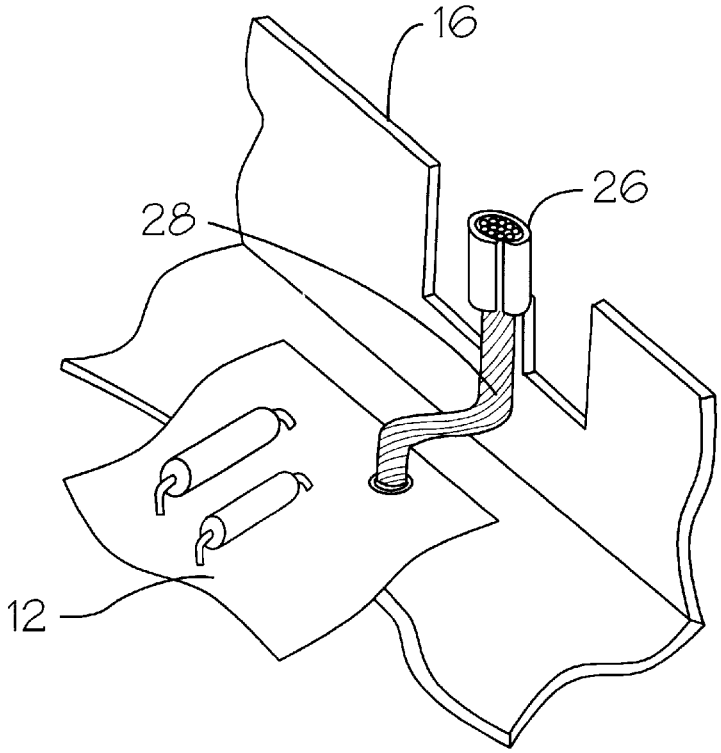
Figure 2B:
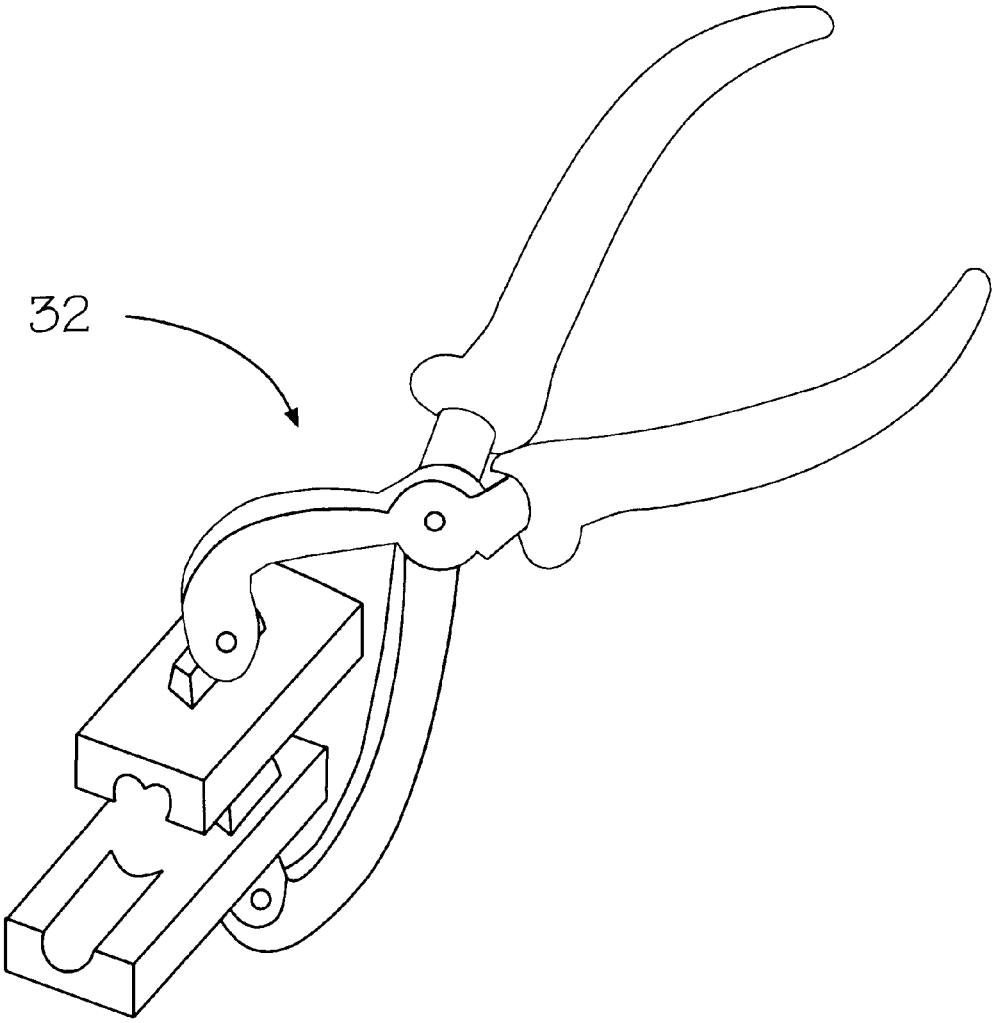
FIG. 2*b* is a perspective view of a crimping tool for use in forming the grounding crimp connection of FIG. 2*a;*
Figure 2C:
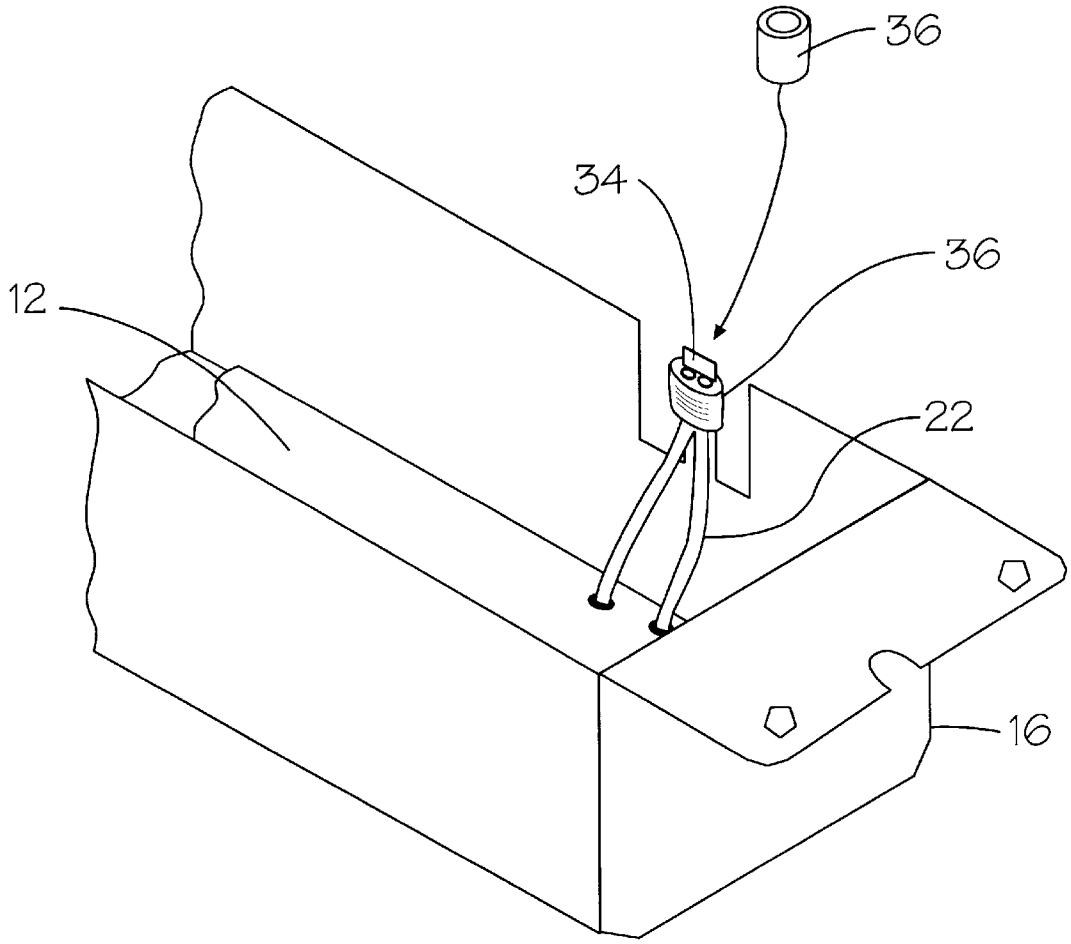
FIG. 2C is a perspective view of an alternate embodiment of a case-grounding system.

Connection from the ballast circuit 12 to the safety earth ground represented by the luminaire (not shown) and ballast case 10 must be made in order to achieve low rf emissions from the ballast. Referring now also to FIG. 2*a,* there is shown a perspective view of a portion of ballast case top 16. Case top 16 includes a grounding connection means 26 in which a crimp connection is made directly to ground wire 28 and the circuit board 12 using a formed connector 30 bent from the case metal of case top 16 itself. Referring now also to FIG. 2*b,* there is shown a hand tool 32 which may be used to form crimped connection 26 at assembly time in a simple low cost crimp operation. The compression type of crimp connection 26 is a reliable, low resistance connection. Referring now to FIG. 2*c,* there is shown an alternate embodiment of a case-grounding system. A simple tab 34 is formed in case top 16. Ground wires 22 are crimped to tab 34 using a commercially available crimping ring 36 such as Molex catalog number CS303.

Figure 3:
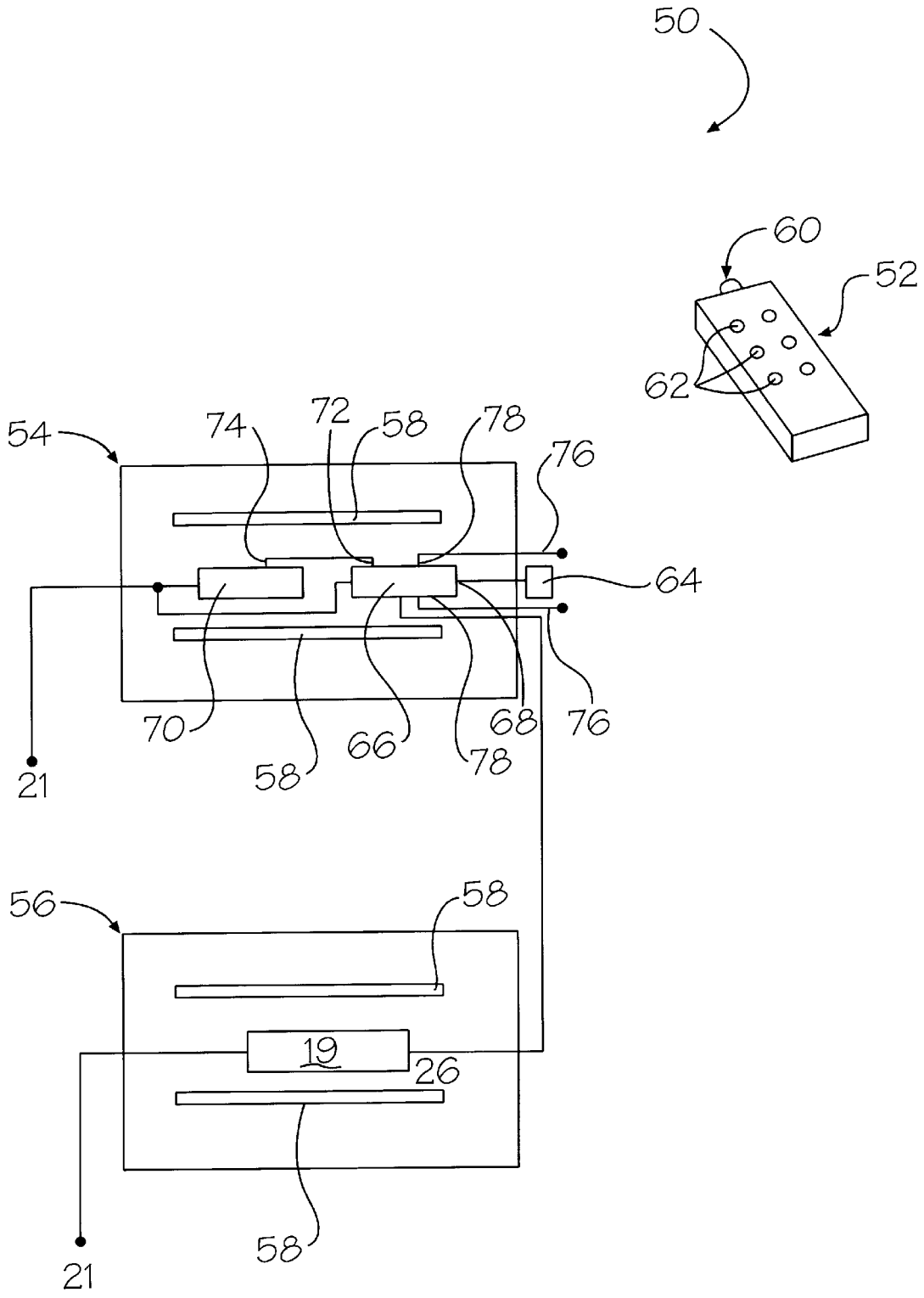
FIG. 3 is system block diagram of a lighting system using the electronic ballasts of the present invention including a hand-held, IR controller for controlling the ballasts.

Referring now to FIG. 3, there is shown generally at reference number 50 a block diagram of a lighting system including three of the dimmable electronic ballasts of the present invention controlled by a hand-held, infrared-generating (IR) controller 52. Two luminaires 54, 56 each containing two fluorescent lamps 58. Lamp wiring and the detailed wire layout of the devices are not shown for simplicity but the wiring follows procedures well known to those skilled in the art. The circuit of the IR transmitting device 52 is not shown as it uses circuits well known to those skilled in the art. Transmitting infrared LED diode 60 emits a coded signal (not shown) when the push buttons 62 on controller 52 are depressed. This coded signal (not shown) is received by sensor 64 (on or near luminaire 54) which is connecting to decoding unit 66 through port 68. A pulse width modulated current is transmitted to the ballast 70 from decoder port 72 to ballast port 74. This signal is used to transmit dimming commands to the ballast 70. Also transmitted through this port 74 are power on/off commands. A similar set of signals can be sent to a number of separate luminaires such as luminaire 56. An output port 78 on luminaire 54 provides output signals 76 which are connections for the control of drapery motors. The power, fusing, and forward/reverse switching for these motors may be contained within decoding unit 66. It will be obvious to those skilled in the art than various control and/or powering arrangements for ancillary equipment such as drapery motors could easily be provided.

Figure 4:
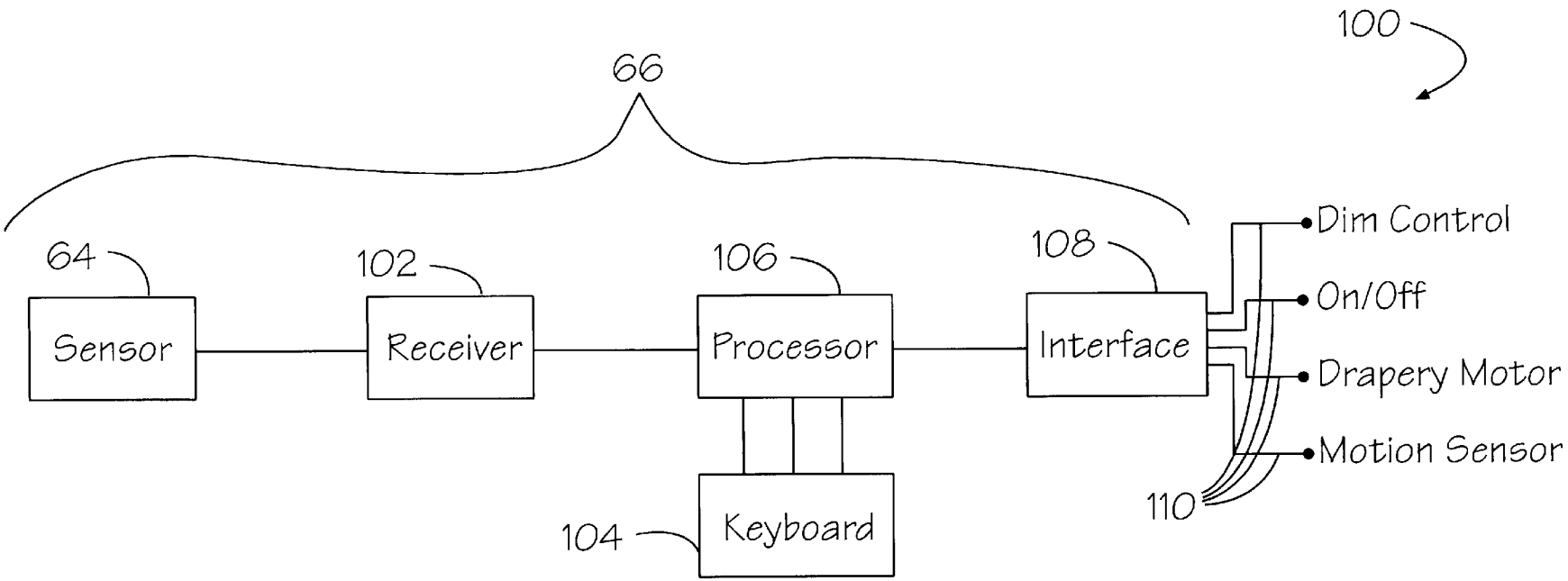
FIG. 4 is a block diagram of the decoding unit of the lighting system shown in FIG. 3.

Referring now to FIG. 4, there is shown a block diagram of the decoding unit 66 (FIG. 3), generally at reference number 100. The decoding function performed within decoding unit 66 is well known to those skilled in the art and is not described in detail. An IR coded signal (not shown) from hand-help IR controller 52 (FIG. 3) is received by sensor 64, and filtered, amplified and detected in receiver circuit 102, and sent to processor 106. Processor 106 may also receive commands from keyboard 104, and motion sensors (not shown) that may be wired into the unit. Upon receipt of valid commands, processor 106 controls interface 108 which sends out commands 110 as required. Commands 110 include: dimming control, power on/off, and drapery motor functions. Decoder 66 contains a separate power supply (not shown) so that its receiver is active even if the ballast unit is turned off.

Figure 5:
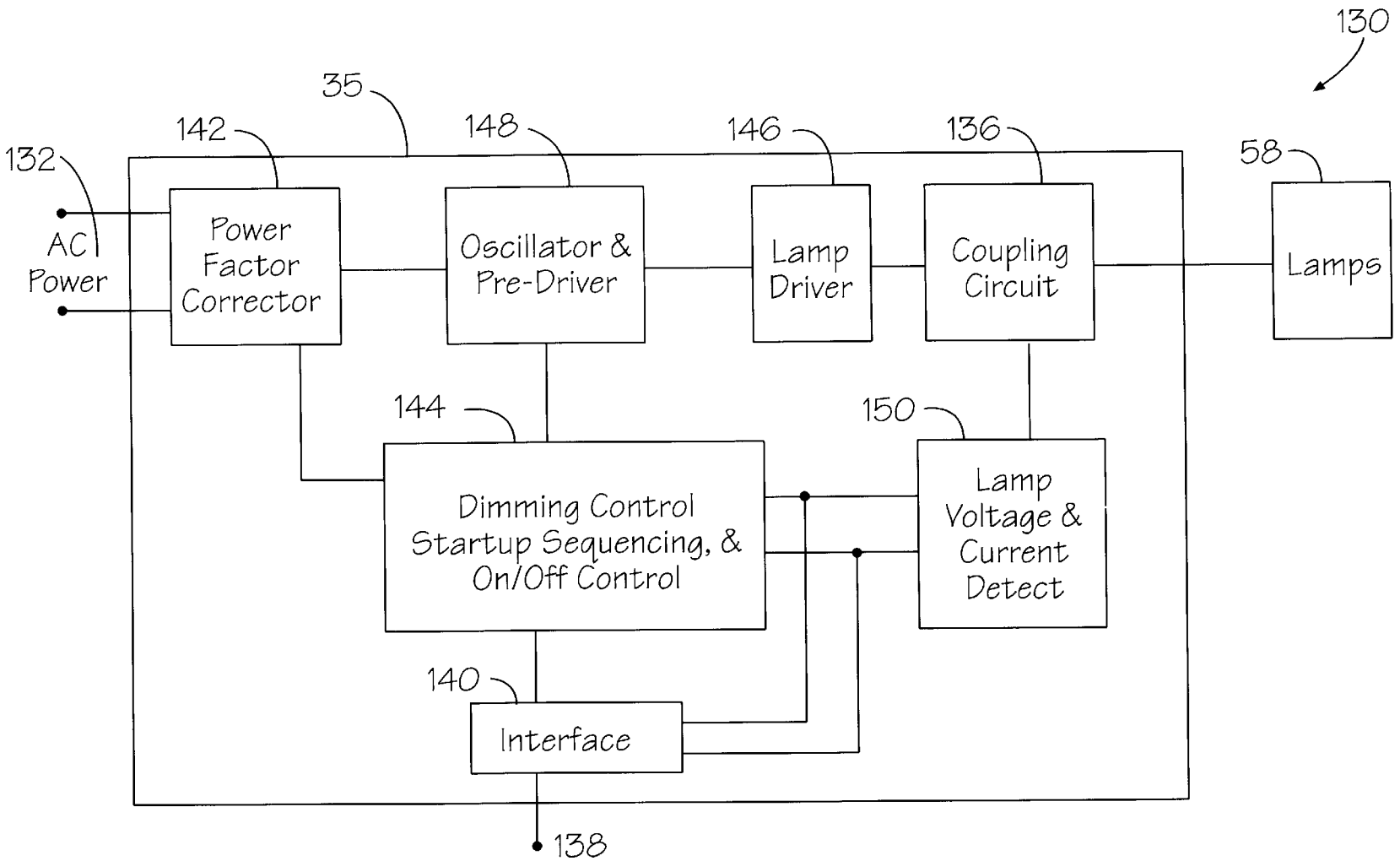
FIG. 5 is a block diagram of the dimmable, electronic ballast of the present invention.

Referring now to FIG. 5, there is shown a block diagram of the dimmable, electronic ballast of the present invention, reference number 130. AC power 132 is converted to high frequency voltage typically in the range of 20–200 kHz and applied to the lamps 58 through coupling circuit 136. External connections 138 connect to an interface circuit 140 which provides appropriate voltages and currents. Within ballast 130, the ac power 132 is converted to dc by means of an active power factor correction circuit 142. This circuit 142 can be disabled by command from control circuit 144 to stop the ballast operation. DC power is applied to the lamp driver 146 which converts the DC power to the high frequency signal for transmission to the coupling circuit 136. The frequency of operation is determined by an oscillator 148. The frequency of oscillator 148 may be changed for different ballast operating requirements. During normal, full power (full brightness) operation, the frequency of oscillator 148 is set near the maximum of the resonance in the output coupling circuit 136. During the initial time before an arc is struck and the lamp filaments are being pre-heated, the frequency of oscillator 148 may be set relatively high so that little voltage appears across the lamps 58 when the filaments are cold. To strike the arc, the frequency is brought near the frequency of the peak of the resonant frequency of coupling circuit 136. Then a very high voltage appears across the lamps, the discharge forms, lowering the Q of the resonant circuit and the applied lamp voltage. For dimming operation, after striking the arc, the frequency of oscillator 148 is raised. This lowers the current coupled into the lamps 58. The lamp resistance increases because gas discharge lamps exhibit a negative resistance characteristic. The circuit Q increases which decreases the lamp current still further. Because of this interaction of the lamp 58 with the tuned coupling circuit 136, a feedback circuit formed by the lamp voltage/current sensing circuit 150 and control circuit 144 is required to stabilize operation. These frequency changes are accomplished by circuitry of control circuit 144. Circuit 150 senses lamp voltage and current for the feedback system, but also these signals can be fed to the interface for sensing by external purposes.

Figure 6:
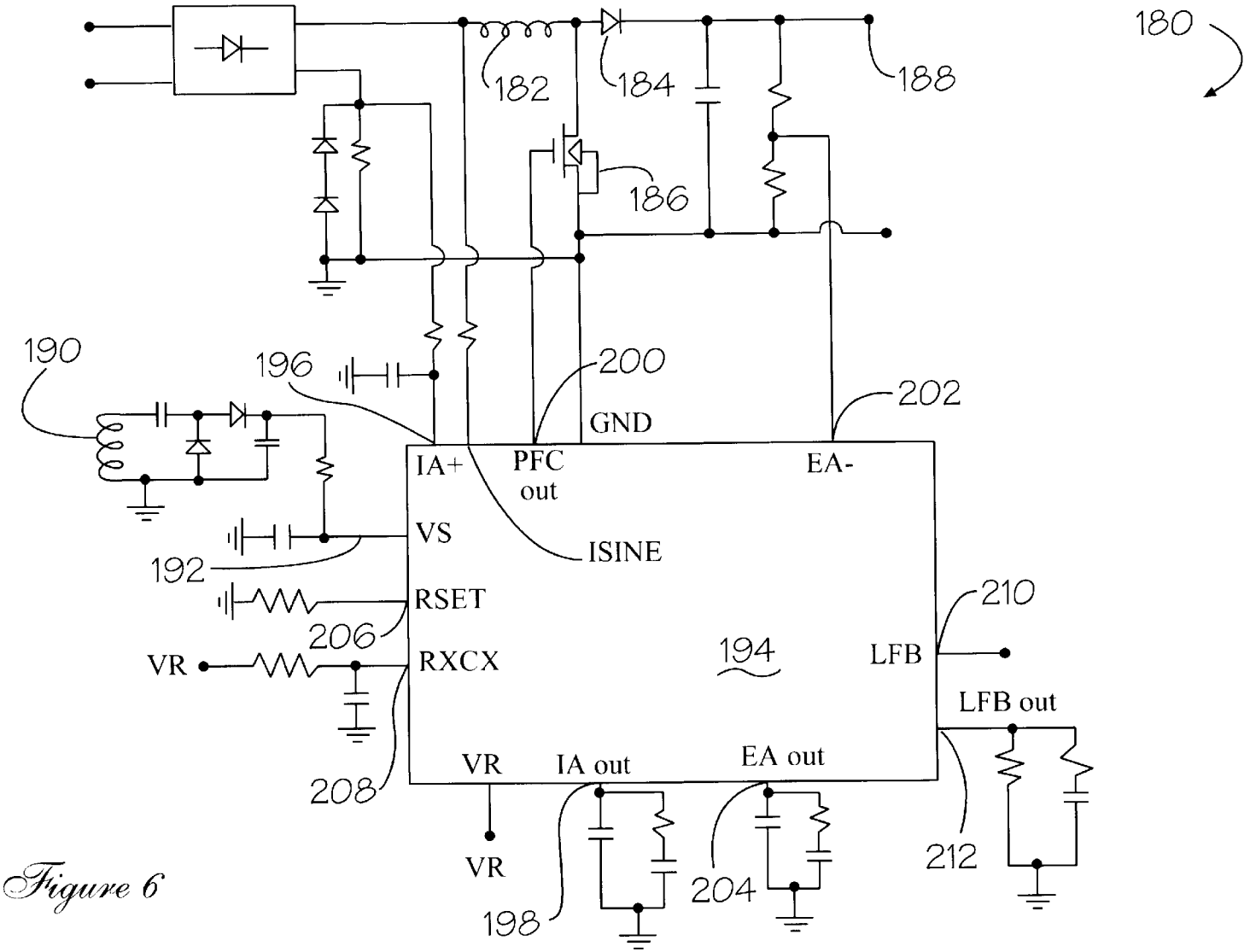
FIG. 6 is a schematic diagram of a power factor correction forming a part of the dimmable, electronic ballast of the invention.

The electronic dimming ballast 130 of the present invention utilizes the catalog number ML4832 integrated circuit (IC) ballast controller chip made by MicroLinear, 2092 Concourse Drive, San Jose, Calif. 95131. This IC is similar to that described in U.S. Pat. No. 5,315,214, entitled "Dimmable High Power Factor High-Efficiency Electronic Ballast Controller Integrated Circuit with Automatic Over-Temperature Shutdown", by Lesea, dated May 24, 1994. The ML4832 is unique in that it combines power factor correction functions and ballast control function in a single IC. Other chips from other manufacturers could be used as well, as the same design principles may be applied. Approaches using other IC devices should be obvious to those skilled in the art. Sectioned schematic diagrams will be shown for clarity is describing the essential points of the invention, the details not explained can be found by referencing the MicroLinear for literature for the ML4832 chip. Referring first to FIG. 6, there is shown a schematic diagram of the power factor correction circuit 142 (FIG. 5) of the ballast 130, generally at reference number 180. This power factor (pf) correction circuit is a standard continuous boost topology power factor corrector, utilizing boost inductor 182, boost diode 184, and switching MOSFET 186 to produce boosted dc output 188. A winding 190 of inductor 182 provides power to operate the IC 194 after startup. The full wave charge pump supply is an important addition to the circuit of a dimming ballast, as it supplies adequate power VS, 192 to the IC 194, even at low dimming levels. The connections to the IC 194 relevant for power factor correction are shown in FIG. 6. IA+ 196 and Iaout 198 are the sense input and compensation port for the ac current sensing function respectively. PFCout 200 provides the gate drive to the MOSFET, 186 and the dc output voltage level is sensed and compensated with ports EA– 202 and Eaout 204, respectively. Input RSET 206 sets a reference current level within the chip 194, and RXCX 208 sets startup timing. LFB 210 and LFBout 212 are inputs and outputs of the operational amplifier used to control oscillator frequency.

Figure 7:
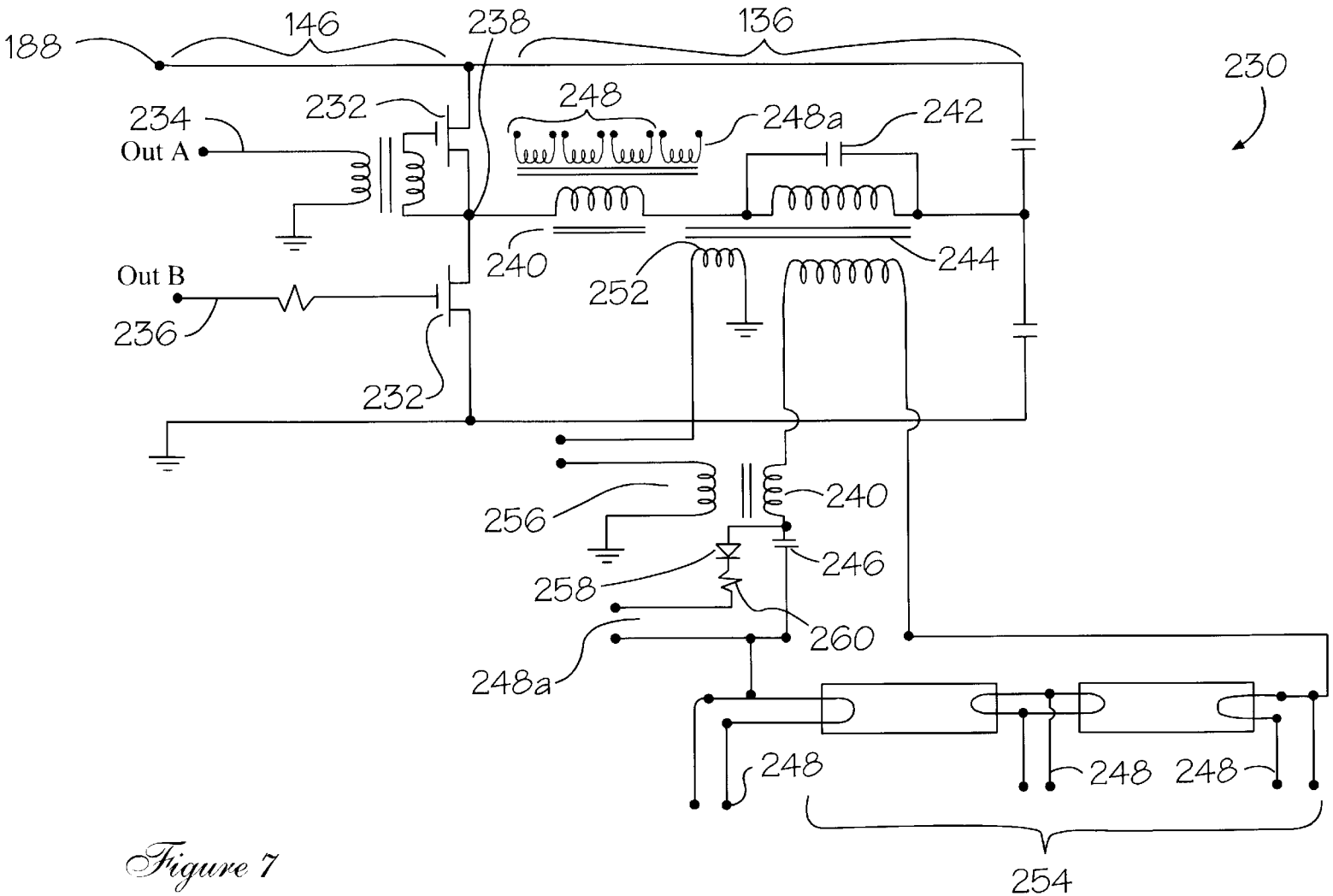
FIG. 7 is a schematic diagram of the lamp drive circuitry forming a part of the dimmable, electronic ballast of the invention.

Referring now to also FIG. 7, there is shown a schematic diagram of the lamp driver 146 (FIG. 5), coupling circuit 136 (FIG. 5) and lamp circuitry 254, generally at reference number 230. The circuit is a standard voltage fed series resonant half bridge. DC power 188 is applied to the series MOSFETs 232 that are driven by IC signals OUTA 234 and OUTB 236. A square voltage waveform at node 238 drives current through the series resonant circuit, inductor 240 and capacitor 242 form the primary resonance. Transformer 244 couples the voltage across capacitor 242 onto the lamp network, and serves the purpose of isolating the lamp network from the ac line connected ballast circuitry for safety purposes. Capacitor 246 blocks dc current from the lamps, connections 248 provide filament voltage to the lamps, current transformer 240 serves as a means for monitoring lamp current, and auxiliary winding 163 provides a means for monitoring the voltage across the lamp string for the lamp current and voltage detect function of circuit 150 (FIG. 4).

Transformer winding 256, series diode 258 and resistor 260 provide a small DC voltage across capacitor 262. This voltage aids in the removal of moving stripes known as "striations" that are often apparent at low (deep) dimming levels. This approach is well known to those skilled in the art, having been disclosed in 1934 in U.S. Pat. No. 2,091,953 to Becquemont.

Figure 8:
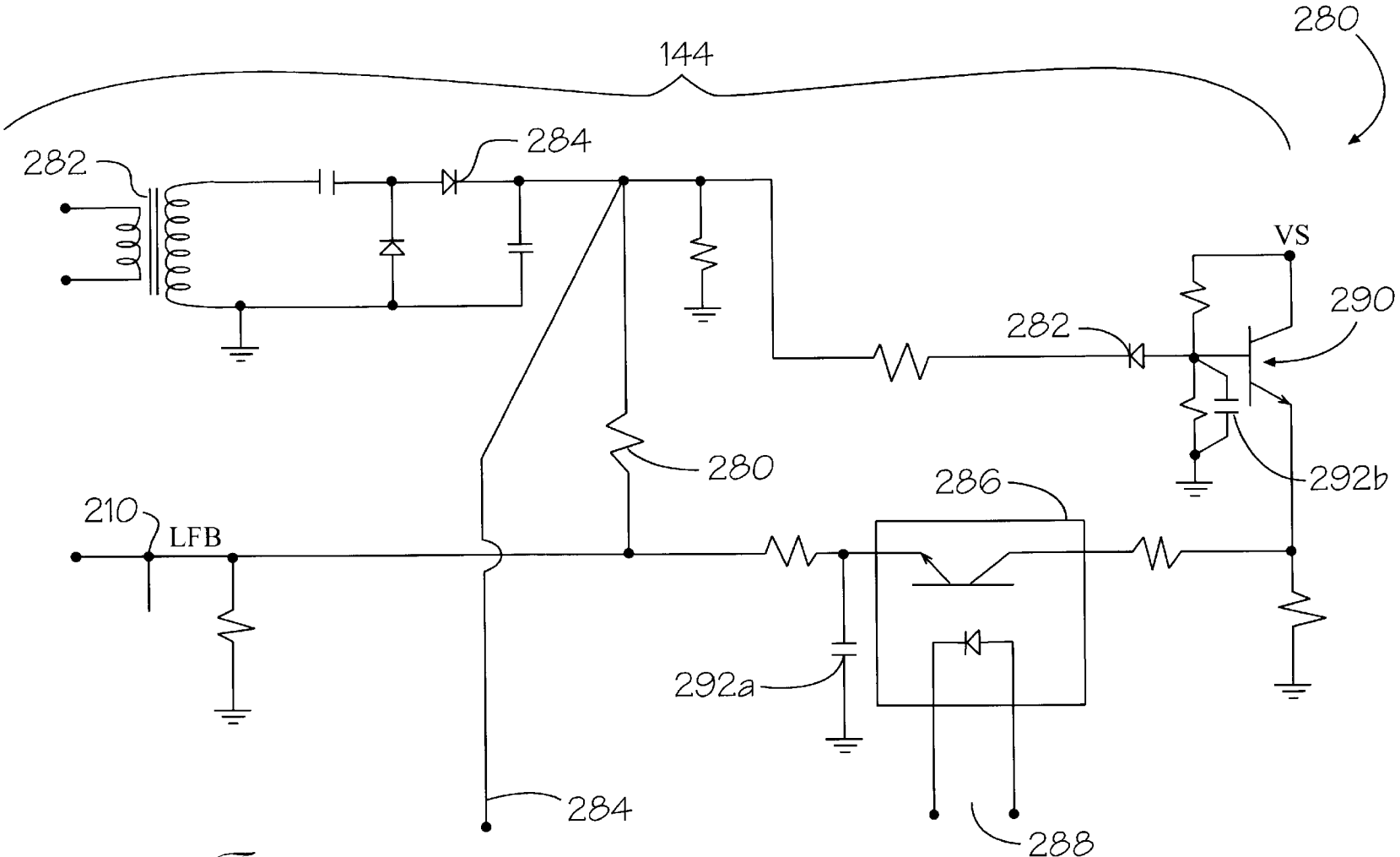
FIG. 8 is a schematic diagram of the dimming control circuitry forming a part of the dimmable, electronic ballast of the invention.

Referring now also to FIG. 8, there is shown a schematic diagram of the dimming control circuitry 144 (FIG. 5), generally at reference number 280. Dimming of the lamps 58 (FIG. 5) is accomplished by raising the frequency of operation of the oscillator 148 within the IC 194 by increasing the voltage on IC 194 input LFB 210. For stability it has been found that a closed servo control loop is needed at low dimming levels. Current injected into this control loop accomplishes the dimming control function. The voltage output from lamp current transformer 282 is rectified by full wave charge pump circuit 284. It is important to full wave rectify the transformer 282 output to maintain linearity of the transfer of the current signal into voltage, any dc tends to imbalance the magnetic core of transformer 282, destroying the linearity of the current-voltage relation. At higher lamp current levels, principal dimming feedback current flows through resistor 280, as diode 282 is non-conducting. External dimming control is accomplished by sending a control current from port 288 through the diode of opto-coupler 286, this can be accomplished by either a steady current of adjustable magnitude, or preferably, by a stream of digital pulses of controlled duty cycle. The average current through the transistor of coupler 286 forms the external dimming control stimulus. For low dimming levels, diode 282 conducts. The feedback necessary for lamp stability is then produced by modulating the voltage division at the input to emitter follower 290. A dc voltage proportional to the lamp current is obtained at input 284 and is suitable for external interfacing. Integrating capacitors 292*a* and 292*b* slow the operation of the dimming feedback control loop and cause the changes in the light level to occur in a smooth manner. Proper selection of component values permits operation with little overshoot, undershoot, or ringing.

Figure 9:
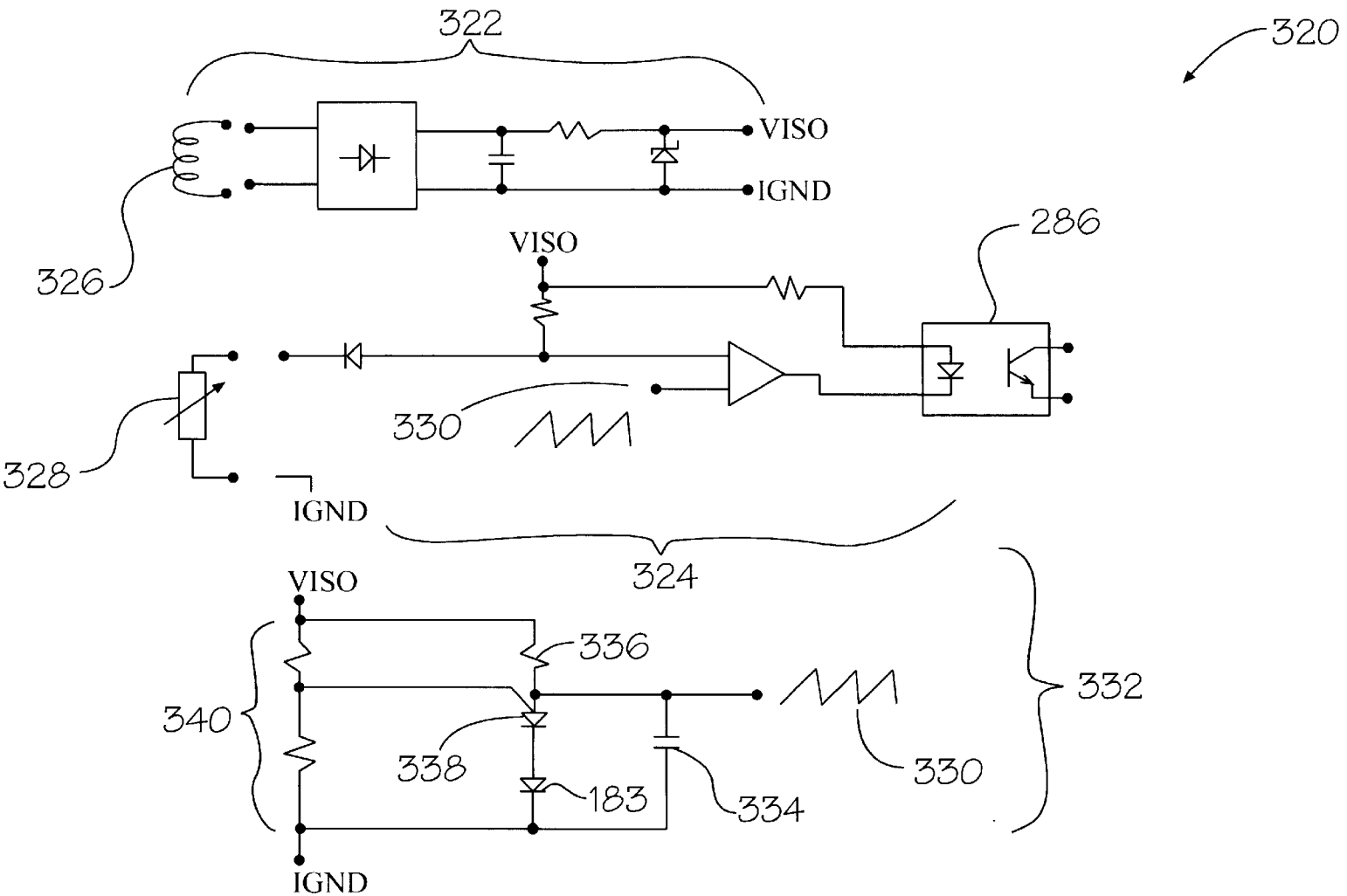
FIG. 9 is a schematic diagram of additional dimming control circuitry for use with the dimmable, electronic ballast of the invention.

Referring now to FIG. 9, there is shown a schematic diagram of one possible circuit for customizing the dimmable electronic ballast of the present invention, generally at reference number 320. The circuit of FIG. 9 may be packaged on auxiliary circuit card 22 (FIG. 1). Circuit 320 consists of three circuits: a first circuit 322 which produces an isolated 10 DC volt supply, VISO. Power for the VISO supply is obtained from winding 326 that is added onto ballast isolation transformer 244 (FIG. 7) in the lamp coupling circuit 136 (FIG. 5). VISO is referenced to isolated ground IGND.

A second circuit 324 is a pulse-width modulator which combines an analog voltage proportional to a 0–10 volt dimming signal 328 with a sawtooth wave at input port 330 to form a repeated pulse whose width is proportional to the dimming signal 328.

Circuit 332 is a standard unijunction relaxation oscillator sawtooth generator. Capacitor 334 charges through resistor 336, and is discharged periodically through unijunction device 338 when the capacitor voltage reaches the threshold potential set by divider 340. This entire circuit can be placed on an auxiliary card 22 (FIG. 1) for a ballast that has 0–10 volt dimming capability.

Figure 10:
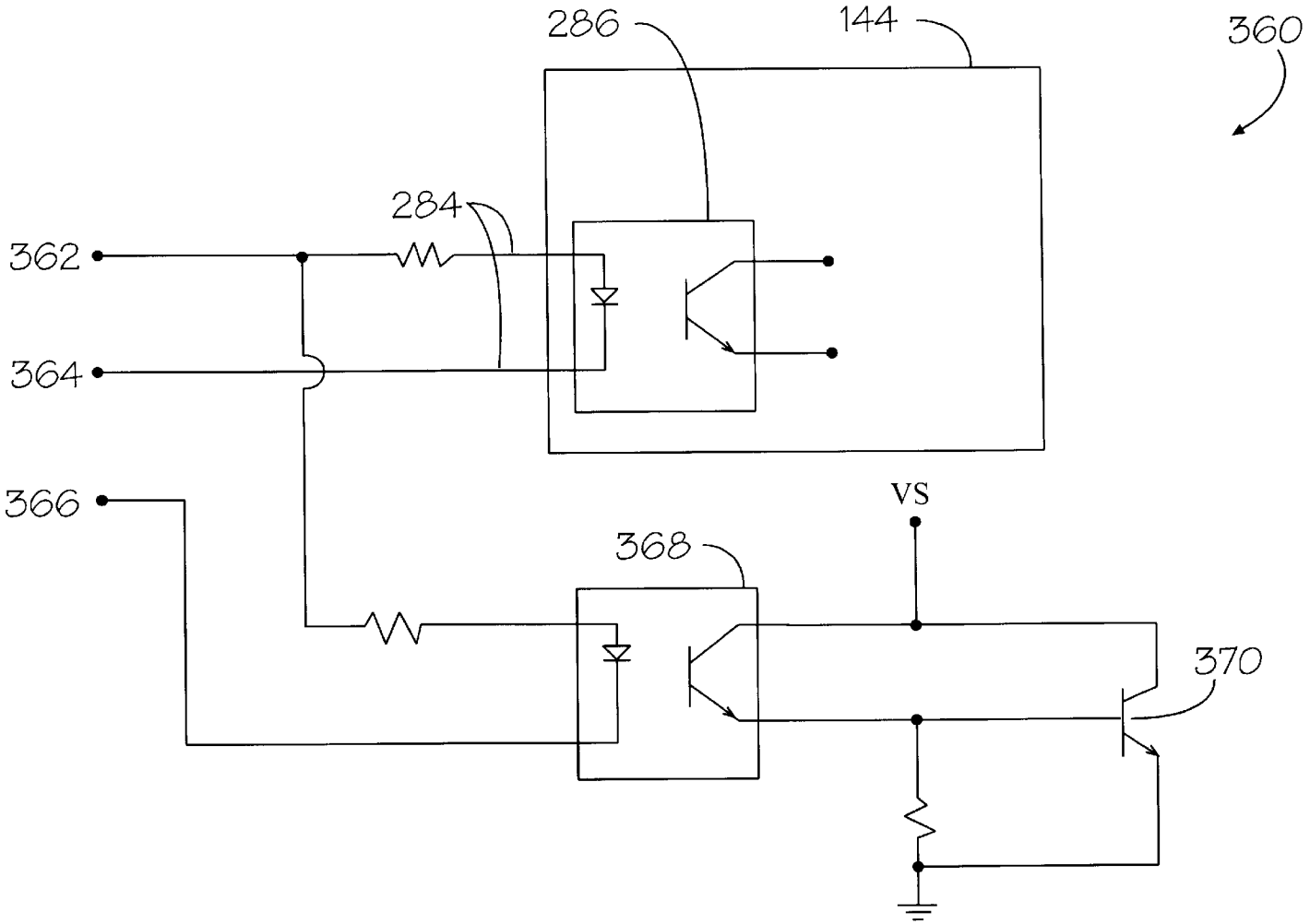
FIG. 10 is a schematic diagram showing the connection of the additional dimming control circuitry of FIG. 9 and circuitry to turn lamps on and off without the need for an external relay.

Referring now to FIG. 10 there is shown a circuit that is suitable for controlling the dimming function by pulse width modulation signals that can be obtained, for example, from a micro-controller. Current pulses from input 362 that return to connection 364 are passed through the LED diode of opto-coupler 286 at connection 284. These pulses control the dimming current within dimming control circuit 144. Pulses of 0% duty cycle produce essentially no dimming, while pulses of 100% duty cycle produce essentially full dimming. On/off control may be obtained by passing current from input 362 to external connection 366. This current allows the transistor of opto-coupler 368 to conduct which switches on pass transistor 370, shorting chip supply VS to a voltage below its activation threshold which stops all ballast operation. An open circuit at input port 330 (FIG. 9) removes the short and ballast operation resumes. In this way ballast operation can be controlled without the use of expensive external ac switching relays. This entire circuit can also be placed on an auxiliary card 22 and results in a ballast that has pulse width modulation dimming capability, along with a low voltage controlled on/off function.

Since other modifications and changes varied to fit a particular operating requirements and environment will be apparent to those skilled in the art, the invention is not considered limited to the example chosen for purposes of disclosure, and covers all changes and modifications which do not constitute a departure from the true spirit and scope of the invention.

Having thus described the invention, what is desired to be protected by Letters Patent is presented in the subsequent appended claims.

What is claimed is:

1. An electronic ballast for exciting a gas-discharge lamp to produce a varying light output level related to a variable lamp current provided thereto, comprising:

a) a ballast circuit for providing a variable output lamp current responsive to an input signal;

b) lamp current monitoring means operatively connected to said ballast circuit for producing a lamp current signal representative of said lamp current;

c) a first feedback path between said ballast circuit and said lamp current monitoring means operable primarily when said lamp current is within a first, predetermined range of lamp current values;

d) a second, parallel feedback path between said ballast circuit and said lamp current monitoring means operable primarily when said lamp current is within a second, predetermined range of lamp current values; and e) means for generating a control signal operatively connected to said ballast circuit and operating cooperatively with said first feedback and said second feedback path to set a specific output lamp current value and a specific light output level related thereto, by providing said input signal to said ballast circuit;

whereby said specific output lamp current and said related specific light output level is maintained at a substantially constant level.

2. The electronic ballast for exciting a gas-discharge lamp as recited in claim 1, wherein said first predetermined range of lamp current values corresponds to a predetermined range of light output levels and said second predetermined range of lamp current values corresponds to a second, higher range of light output levels.

3. The electronic ballast for exciting a gas-discharge lamp as recited in claim 2, wherein said means for generating a control signal comprises means for setting a light level.

4. The electronic ballast for exciting a gas-discharge lamp as recited in claim 3, wherein said means for setting a light level comprises at least one from the group of dimmer, occupancy sensor, ambient light level sensor, building energy management system and remote control unit.

5. The electronic ballast for exciting a gas-discharge lamp as recited in claim 4, wherein said ballast circuit comprises a printed circuit board adapted to receive a daughter card and wherein said means for generating a control signal comprises interface means substantially implemented on said daughter card.

6. The electronic ballast for exciting a gas-discharge lamp as recited in claim 5, wherein said ballast circuit operates independently of an absence or presence of said daughter card.

7. The electronic ballast for exciting a gas-discharge lamp as recited in claim 6, wherein said means for setting a light level comprises at least one component located remotely from said daughter card.

8. The electronic ballast for exciting a gas-discharge lamp as recited in claim 4, wherein said ballast is continuously connected to a power source and said output lamp current is reduced substantially to zero.

9. An electronic ballast for exciting a gas-discharge lamp to produce a varying light output level related to a variable lamp current provided thereto, comprising:

a) a housing;

b) a circuit board located within said housing comprising a ballast circuit for providing a variable output lamp current responsive to an input control signal;

c) lamp current monitoring means operatively connected to said ballast circuit for producing a lamp current signal representative of said lamp current;

d) first feedback means disposed between said ballast circuit and said lamp current monitoring means for applying said lamp current signal to said ballast circuit as an input control signal, said first feedback means being operable primarily when said lamp current is within a first, predetermined range of lamp current values;

e) second, parallel feedback means disposed between said ballast circuit and said lamp current monitoring means being operable primarily when said lamp current is within a second, predetermined range of lamp current values; and f) means for generating a control signal operatively connected to at least one of said first feedback means and said second, parallel feedback means, whereby said output lamp current and said related light output level is varied by said control signal.

10. The electronic ballast for exciting a gas-discharge lamp as recited in claim 9, wherein said ballast is continuously connected to a power source and said output lamp current is reduced substantially to zero.

11. The electronic ballast for exciting a gas-discharge lamp as recited in claim 9, wherein said circuit board is adapted to receive a daughter card.

12. The electronic ballast for exciting a gas-discharge lamp as recited in claim 11, wherein said ballast circuit operates independently of an absence or presence of said daughter card.

13. The electronic ballast for exciting a gas-discharge lamp as recited in claim 12, wherein said daughter card comprises said means for generating a control signal.

14. The electronic ballast for exciting a gas-discharge lamp as recited in claim 13, wherein said means for generating a control signal comprises means for setting a light level.

15. The electronic ballast for exciting a gas-discharge lamp as recited in claim 14, wherein said means for setting a light level comprises at least one from the group of dimmer, occupancy sensor, ambient light level sensor, building energy management system and remote control unit.

16. The electronic ballast for exciting a gas-discharge lamp as recited in claim 15, wherein said means for setting a light level comprises at least one component located within said housing.

17. The electronic ballast for exciting a gas-discharge lamp as recited in claim 16, wherein said means for setting a light level comprises at least one component located outside said housing.

18. An electronic ballast for exciting a gas-discharge lamp to produce a varying light output level related to a variable lamp current provided thereto, comprising:

a) a ballast circuit for providing a variable output lamp current responsive to an input control signal;

b) lamp current monitoring means operatively connected to said ballast circuit for producing a lamp current signal representative of said lamp current;

c) feedback means disposed between said ballast circuit and said lamp current monitoring means comprising a variable gain circuit which increases a loop gain at low light levels to maintain a stable light output from said gas-discharge lamp; and d) means for generating a control signal disposed on a daughter card and operatively connected to said feedback means whereby said output lamp current and said related light output level is varied by said control signal;

said ballast circuit being continuously connected to a power source and said output lamp current being reduced substantially to zero.

19. The electronic ballast for exciting a gas-discharge lamp as recited in claim 18, wherein said means for setting a light level comprises at least one from the group of dimmer, occupancy sensor, ambient light level sensor, building energy management system and remote control unit.

* * * * *